US006102226A

United States Patent [19]

Verderber

[11] Patent Number: 6,102,226

[45] Date of Patent: Aug. 15, 2000

[54] TEAR TAB FOR BOTTLE CAP

[75] Inventor: Rudolph R. Verderber, San Jose, Calif.

[73] Assignee: Portola Packaging, Inc., San Jose, Calif.

[21] Appl. No.: 09/184,207

[22] Filed: Nov. 2, 1998

[51] Int. Cl.[7] ..... B65D 39/00

[52] U.S. Cl. ..... 215/254; 215/256

[58] Field of Search ..... 215/249, 251, 215/254, 256; 220/269, 270, 276, 724, 725, 915

[56] References Cited

U.S. PATENT DOCUMENTS

| | | | |
|---|---|---|---|
| 3,163,308 | 12/1964 | Friedell | 215/254 |
| 3,371,814 | 3/1968 | Ruprecht | 215/254 |
| 4,911,316 | 3/1990 | Tackles | 215/256 |
| 5,224,616 | 7/1993 | Crisci | 215/256 |
| 5,370,270 | 12/1994 | Adams et al. . | |
| 5,868,281 | 2/1999 | Bietzer et al. | 215/254 |
| 5,975,320 | 11/1999 | Bietzer et al. | 215/254 |

*Primary Examiner*—Stephen K. Cronin
*Attorney, Agent, or Firm*—Flehr Hohbach Test Albritton & Herbert LLP

[57] ABSTRACT

A bottle cap has a tab formed with internal gripping features which engage mating features on the bottle neck to retain the cap in place until a portion of the skirt is torn. A tab extends from below the bottom edge of the cap. At least one vertical score lines extends up from the bottom edge of the skirt. In one form of the invention, there are two vertical score lines, one on each side of the tab and one preferably extending higher than the other. A rib is formed on either external side edge of the tab and extending partially upward on the exterior of the skirt. The tab angles outward relative to a downward projection of the skirt.

23 Claims, 5 Drawing Sheets

TEAR TAB FOR BOTTLE CAP

BACKGROUND OF THE INVENTION

1. Field of the Invention

This invention relates to a new and improved tear tab for bottle caps. More particularly the invention relates to a tear tab used with bottle caps having vertical score lines extending upward from the bottom edge of the cap skirt. Ribs extending along the side edges of the tear tab and up onto the exterior of the cap skirt are located immediately within the score lines.

2. Description of Related Art

The cap illustrated and described in detail herein is in many respects similar to that disclosed in U.S. Pat. No. 5,370,270 which shows a "non-spill" cap now commonly used in the bottled water industry. It will be understood, however, that the principle of the present invention may be used with caps of different construction.

SUMMARY OF THE INVENTION

A tear tab projects below the bottom edge of a cap skirt. There are vertical tear lines formed on the skirt extending upward from the bottom edge of the skirt at points on either side of the tear tab. Side edge ribs on the tab are tapered in the sense that at different points along their lengths they project out from the tab or the skirt different distances. In general, the maximum distance of projection is at the bottom edge of the skirt. The tab angles outwardly-downwardly relative to a vertical projection of the cap skirt at an angle alpha whereas the top edge of the side ribs on the tab is at an angle beta with respect to the exterior of the skirt. The angle beta is generally less than the angle alpha in at least some of the embodiments of the invention.

The use of the side edge ribs on the tab increases stiffness of the tab. This stiffness transfers the pull force which the consumer applies to the tear tab into tear strain energy. Further, the reinforcement of the edges of the tab greatly reduces any tendency of the tab to bend inward or outward when the cap is applied to a bottle neck.

A feature of the invention is that the tab is constructed in accordance with a general principle of injection molding of plastics known as the "nominal wall theory". Using such principle, it will be seen that the structure of the tab has great strength without requiring thickening of the tab or of the skirt where it merges with the tab except for the side ribs. Hence a nominal wall thickness principle is applied.

One of the problems with prior vertical tabs is that when the cap is applied to the bottle neck with a straight downward force, the lower end of the tab may engage the crown on the lip of the bottle neck in such manner that the tab is bent inward. The structure of the tab of the present invention is such that it is stiffer in resisting inward bending than in resisting outward bending. Stiffening of the tab also insures that it is less likely to be bent during handling in transit along conveyors and chutes, storage, and transportation. Bent tabs also interfere with orientation of caps in spinner bowls which direct the caps to equipment which applies the caps to bottles.

Another feature of the invention is that when the tab tip bends outward-downward the user finds it easier to grip the tab than if the tab lies flat against the bottle neck. Another user feature is that the taper reduces stiffness near the tip, making it easier to grip the tab.

An important benefit of the tab construction is that it tears the cap skirt more effectively. The tab design concentrates high tensile stress near the tear line. Further, the rolling of the tab allows energy transfer into tear energy.

Among the objects and advantages of the invention are the following:

The tab is stiffer than a flat tear tab. More particularly the tab is stiffer against bending inward (i.e., toward the entrance of the cap) than towards the outside of the cap. Again the shape of the tab provides for tapered thickness without violating nominal wall theory. Very importantly, the tab produces effective tears because the tab concentrates maximum tensile stress near the tear line, and the rolling of the tab transforms the pull force energy into tear strain energy.

BRIEF DESCRIPTION OF THE DRAWINGS

The accompanying drawings, which are incorporated in and form a part of this specification, illustrate embodiments of the invention and, together with the description serve to explain the principles of the invention.

DESCRIPTION OF PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
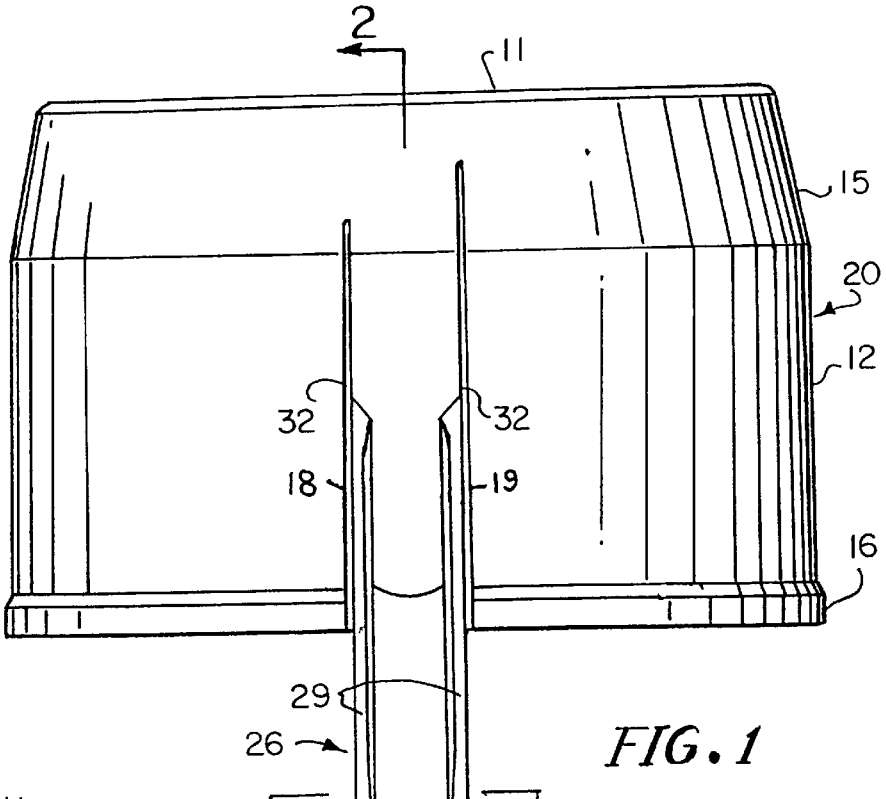
FIG. 1 is a front elevational view of one form of cap in accordance with this invention.
Figure 2:
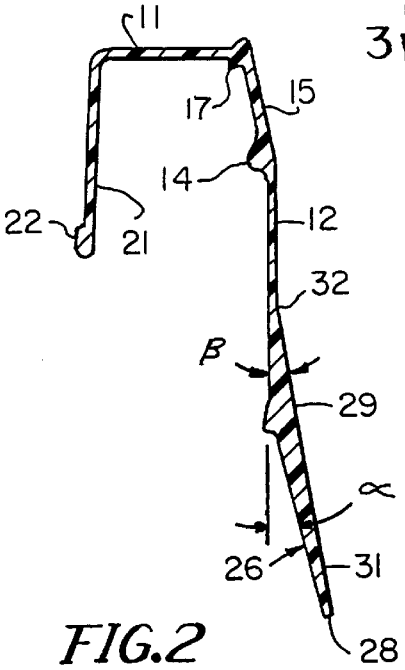
FIG. 2 is a sectional view taken substantially along the line 2—2 of FIG. 1.
Figure 3:
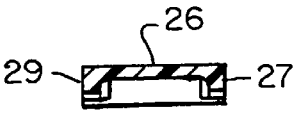
FIG. 3 is an enlarged sectional view taken substantially along line 3—3 of FIG. 1.

Referring to FIGS. 1–3, the cap 10 illustrated and described herein is intended for use with large water bottles (such as 5-gallon bottles) and is of the "non-spill" variety. It will be understood, however, that the invention may be used with caps of other design. The particular cap illustrated has a top 11 from the periphery of which depends skirt 12 having a bottom edge 13. The upper portion 15 of skirt 12 has an inward-upward slant. On the interior of skirt 12 is an upper locking bead 14, which is located approximately at the intersection of the slanted portion 15 and the cylindrical portion 12 of the skirt. Bead 14 engages under a crown conventionally formed on the lip of 5 gallon water bottles. A so-called "non-ovality" bead 16 is an outward projection formed on the exterior of the lower end of skirt 12 to preserve the round shape of skirt 12 and also to rigidify lower edge 13. In the form of the invention shown there is an internal top seal bead 17 at the intersection of top 11 and slanted portion 15 which engages the bottle neck crown to inhibit leakage. A pair of spaced vertical tear lines 18, 19 extend upwardly from bottom edge 13. Line 18 terminates approximately at the level of bead 14 while line 19 extends upwardly into the slanted portion 15. As shown, lines 18 and 19 are on the exterior of skirt 12, but it is possible to form them on the interior. As in accordance with prior caps, one of the tear lines (here designated 19) is longer than the other 18. The upward pulling of the tab and tearing of the skirt in effect interrupts the continuity of locking bead 14 and enables the cap 10 to be pulled off the bottle neck. When the skirt 12 is torn along the lines 18, 19, cap 10 may be removed from the bottle neck.

As has been stated, the specific cap 10 shown is of the "non-spill variety" and for such purpose has a central vertical well 21 having an internal bead 22 at the bottom of well 21. The purpose and function of well 21 will be understood by reference to U.S. Pat. No. 5,370,270 and the references cited therein. Cap 10 is only one type in which the present invention may be incorporated.

The present invention is primarily concerned with the structure surrounding tab 26, which depends from bottom edge 13 and which is located within downward projections of tear lines 18, 19. The function of tab 26 is that when gripped by the consumer and pulled upward it causes skirt 12 to tear along lines 18 and 19 so that the function of bead 14 in retaining the cap on the bottle neck is overcome and continued pulling of tab 26 removes cap 10 from the bottle neck. To facilitate the consumer gripping tab 26, a plurality of ribs 27 (here shown as three) spaced upwardly from the bottom end 28 of tab 26 is formed on the back surface of tab 26.

In accordance with the present invention, a side rib 29 is formed along the exterior of either side edge of tab 26. Each side rib 29 originates at a point 31 spaced slightly upward from bottom end 28 and terminates at point 32 located on skirt 12 approximately halfway between bottom edge 13 and bead 14. The thickness (i.e., projection outwardly from tab 26 or skirt 12) tapers, increases from a minimum at origin 31 to a maximum where ribs 29 project from bottom edge 13 and then decreasing to upper terminus 32.

Figure 1A:
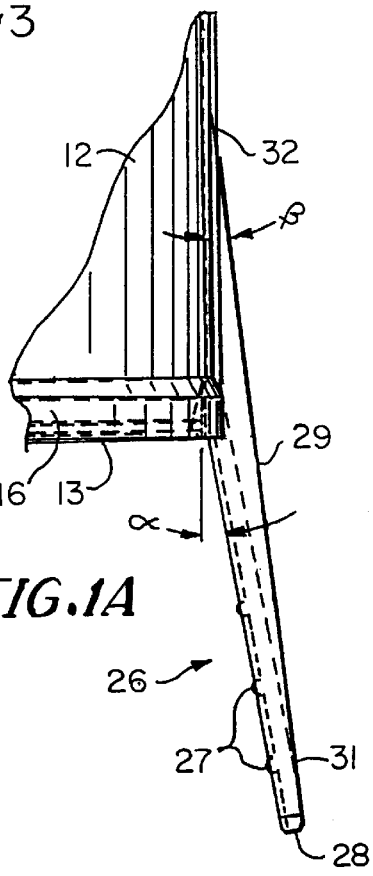
FIG. 1A is a schematic fragmentary side elevational view.

As viewed in FIG. 1A, ribs 29 maintain tab 26 slanting downward-outward away from a vertical projection of skirt 12 at an angle alpha. The upper surface of each rib 29 from origin 31 to upper terminus 32 comprises substantially a straight line which is at an angle beta with respect to vertical skirt 12. As heretofore explained, angle beta is generally less than angle alpha in the embodiment of FIGS. 1–5.

In use, since the tab projects outwardly-downwardly when the cap 10 is applied to a bottle neck, there is no tendency of the crown of the bottle neck to engage bottom end 28 in such manner as to bend the tab 26 inwardly and the ribs 29 reinforce tab 26 against any such bending during transportation or storage or subsequent application. When the cap is applied, it seats on the bottle neck and cannot be removed so long as the tear lines 18, 19 are intact.

To open the bottle, the consumer grips the tab 26. The outward slanting of tab 26 away from the bottle neck facilitates gripping the tab and the transverse ribs 27 improve the user's grip on the tab. The user then pulls vertically upwardly on tab 26 and this causes tearing along lines 18 and 19 and the tab rolls back upon itself almost 180°. Ribs 29 control the bending stiffness of tab 26 along the length of skirt 12. This transforms pull force energy into tear strain energy, reducing the force required to tear the score lines. The cross section of the tab results in an effective tear along lines 18, 19. First, the tab has high tensile stress near the tear lines 18, 19. Secondly, the rolling of the tab 26 allows energy transformation into tear energy, thus making tearing of the lines 18, 19 easier for the consumer.

Figure 4:
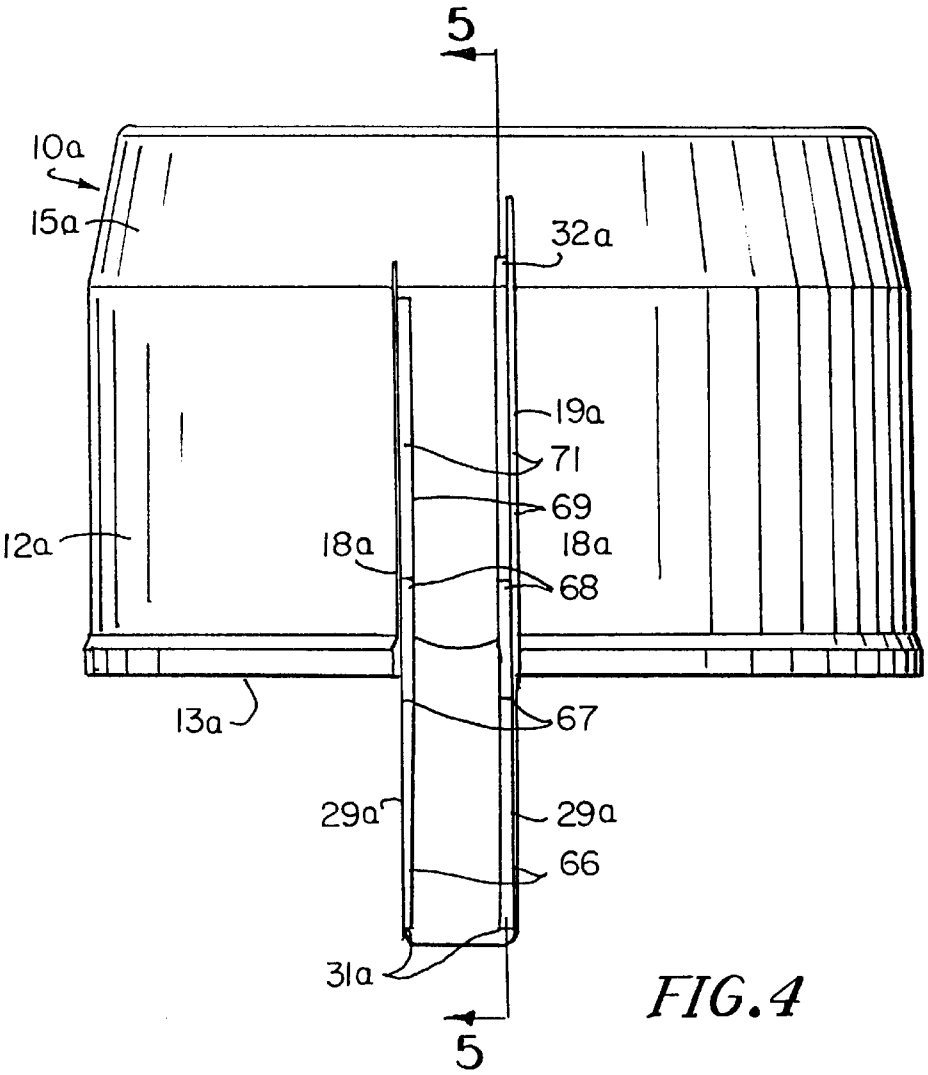
FIG. 4 is a view similar to FIG. 1 of a modification.
Figure 5:
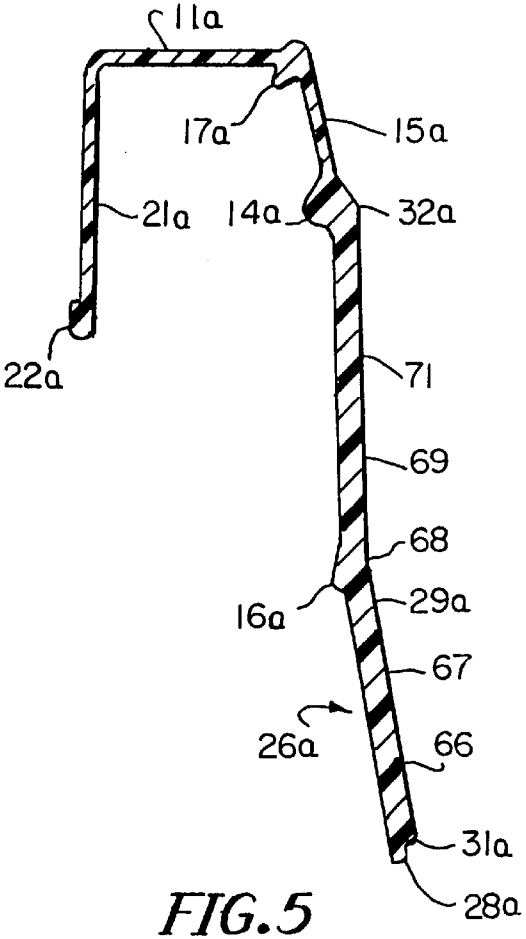
FIG. 5 is a sectional view taken substantially along the line 5—5 of the modification of FIG. 4.

FIG. 4 and 5 show a modification wherein ribs 29*a* extend on either side edge of tab 26*a* from adjacent bottom end 28*a* of tab 26*a* to approximately the upper ends of vertical tear lines 18*a* and 19*a*. In this modification the possibility that upward pulling on tab 26*a* will not cause the vertical tear lines 18*a* and 19*a* to tear along their entire length is reduced.

In the specific rib structure shown in FIGS. 4–5, the contour of the outer edge of ribs 29*a* varies. Each rib has a linear extent 66 from rib origin 31*a* to linear upper end 67, then an arcuate extent 68 from points 67 to the upper ends 69 of arcuate extent 68. From points 69 to rib upper ends 32*a* there is a second linear extent 71.

Figure 7:
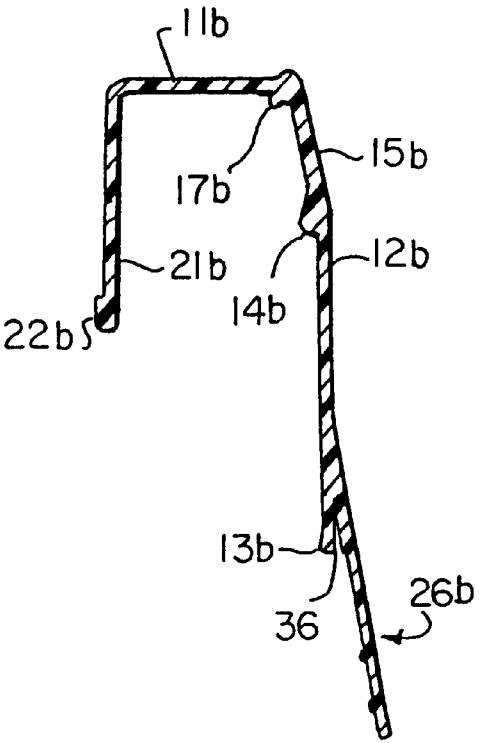
FIG. 7 is a sectional view taken substantially along the line 7—7 of FIG. 6.
Figure 6:
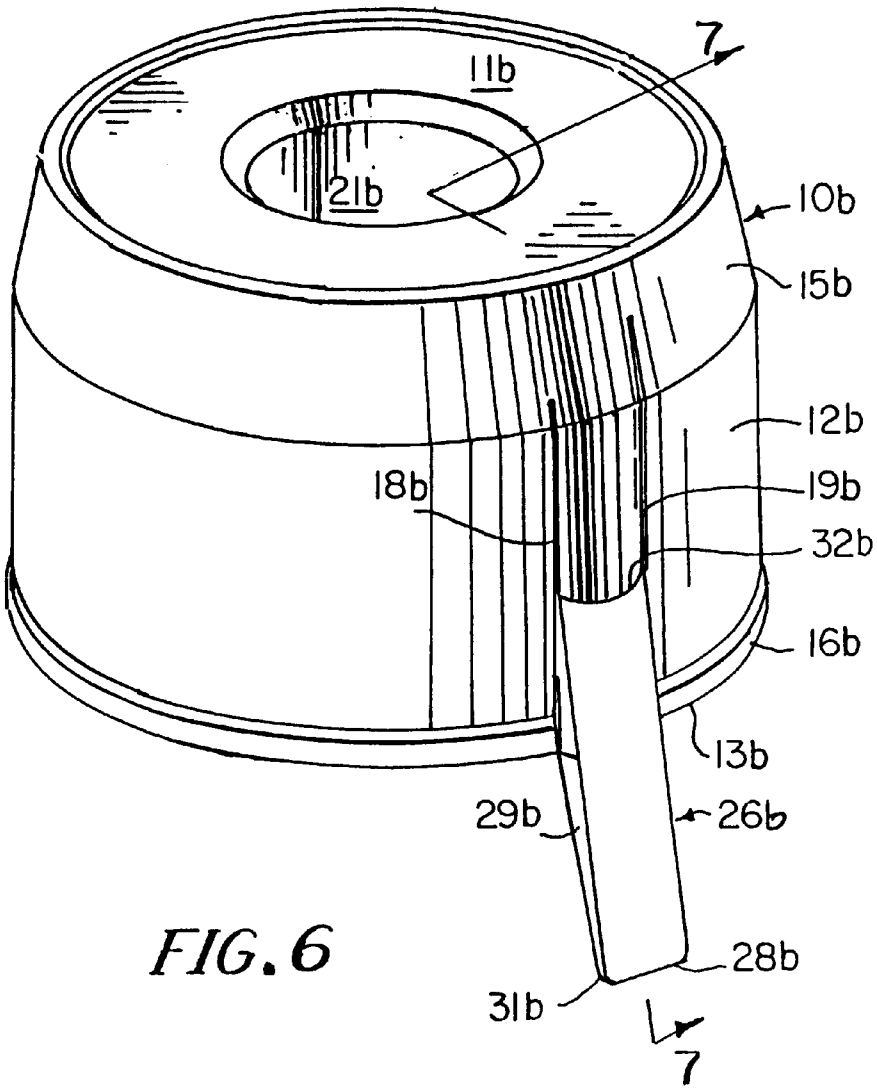
FIG. 6 is a top perspective view of another modification.
Figure 8:
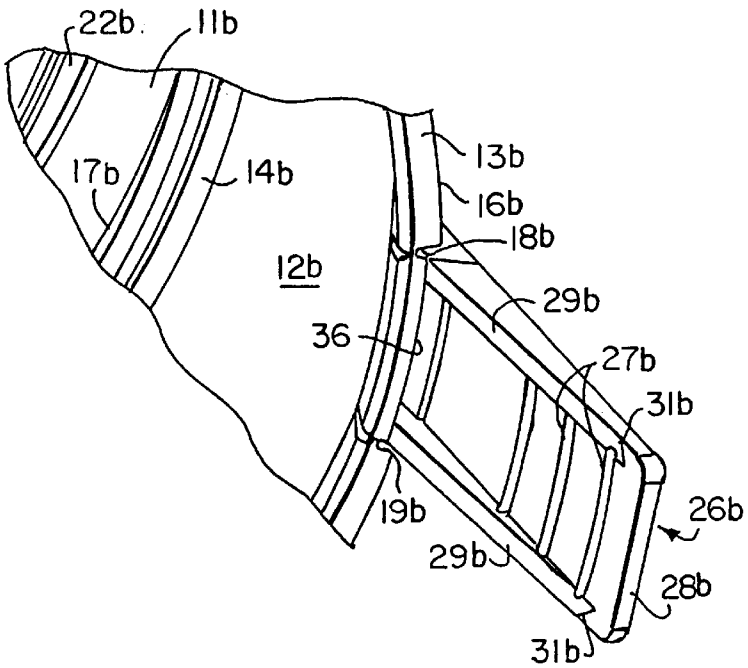
FIG. 8 is a bottom plan view of the modification of FIG. 6.

FIGS. 6–8 illustrate a further modification. Tab 26*b* is formed with side ribs 29*b* on its inner surface (as contrasted with the modification of FIGS. 1–5 where the ribs 29 are formed on the outer surface). A notch 36 is formed in bottom edge 13*b*. The tab 26 is separate and spaced outward of skirt 12*b* above bottom edge 13*b* for a short distance.

Figure 9:
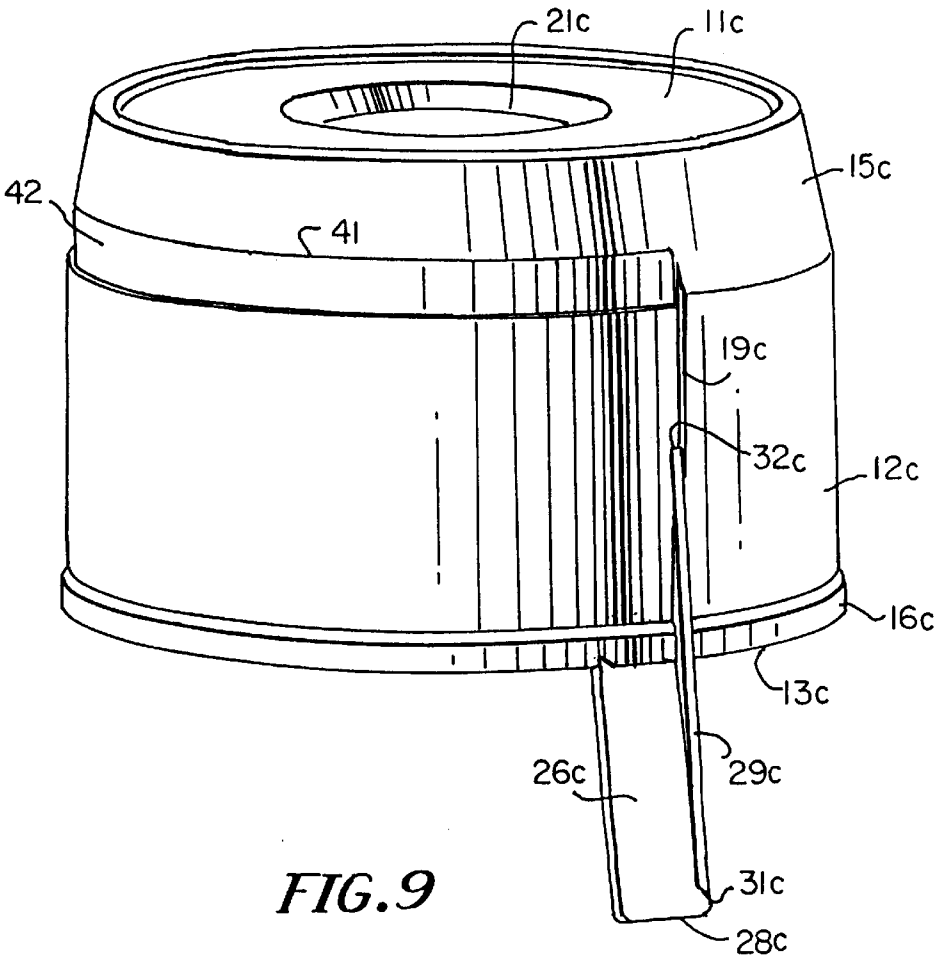
FIG. 9 is a view similar to FIG. 6 of a further modification.
Figure 10:
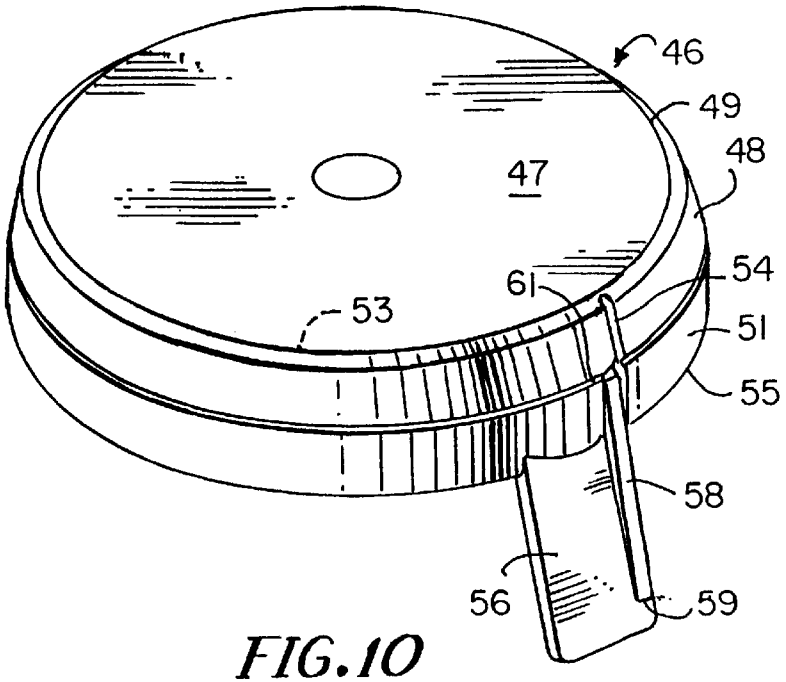
FIG. 10 is a perspective view of a still further modification.

Directing attention now to FIG. 9, only one side edge rib 29*c* is formed on tab 26*c* and only a single vertical tear line 19*c* is used. As shown in FIG. 10, rib 29*c* and tear line 19*c* are shown on the right side of tab 26*c*. However, it will be understood, that these members may be located on the left side of the tab if desired. A horizontal circumferential tear line 41 is formed on inward slanted portion 19*c* of skirt 12*c* and the line 41 may extend circumferentially around the cap or may terminate so that its arcuate length (e.g., 270°) is sufficient so that, when it is torn, the skirt can easily be removed from the container neck. From a production standpoint, in order to withdraw the mold from the cap, it may be necessary to form the lower portion of slanted skirt 15*c* cylindrical as shown in reference numeral 42.

In use of the cap 11*c*, the user grips tab 26*c* and tears upward, the added effect of rib 29*c* causing skirt 12*c* to tear along tear line 19*c* and thence around line 41.

Figure 11:
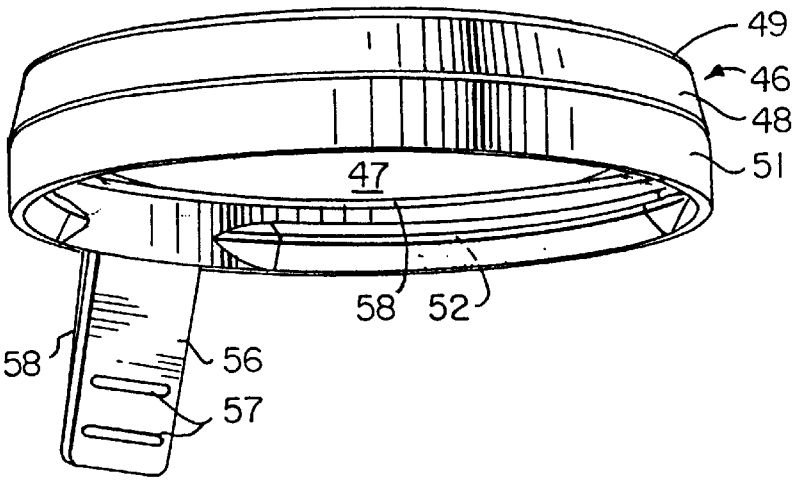
FIG. 11 is a bottom perspective view of the modification of FIG. 10.

The present invention may be incorporated in caps other then the non-spill 5 gallon water bottle cap 10, as will occur to one skilled in the art. One form of cap incorporating the present invention is shown in FIGS. 10 and 11. Cap 46 has a top 47, here shown as a substantially flat disc, and having a peripheral depending outward-downward slanted upper skirt 48 with a bevel 49 interconnecting top 47 and upper skirt 48. Below upper skirt 48 is a substantially cylindrical lower skirt 51. On the interior of skirt portion 51 is an internal locking bead 52 which engages under a bead on the exterior of a container neck. The means for attaching a cap 46 to a neck (not shown) is subject to wide variation. As here shown, bead 52 extends around a substantial portion of the circumference of skirt 51. Bead 52 may be continuous or interrupted, as understood in the art. Extending circumferentially around the top 47 or for a substantial distance around top 47 is a horizontal internal tear line 53, preferably located at the intersection of bevel 49 and top 47. A vertical tear line 54 extends downward from an intersection with line 53 to the bottom edge of lower skirt 51.

Tab 56 depends from the bottom edge 55 of lower skirt 51 adjacent vertical tear line 54. Transverse ribs 57 may be formed on the back of tab 56. In accordance with the present invention, a side rib 58 is formed along the right edge of tab 56 and extends up on the outside of lower skirt 51 in close proximity to line 54. Rib 58 is preferably triangular in side elevation from an origin 59 near the bottom of tab 56 to an upper terminus 61 at the lower edge of upper skirt 48.

To remove the cap 46, as well as other caps employing a single vertical score line, the user grips the tab 56 (the ribs 57 assisting in such effort) and pulls upwardly causing lower skirt 51 and then upper skirt 48 to tear along line 54. Continued pulling on tab 56 causes the cap to sever along line 53. To effectuate the arcuate path of line 53, it is preferable that the user pull the tab 56 in a circular motion after tear line 54 has been severed. Line 53 need not extend around the entire circumference of top 47. If it extends for sufficient distance so that the locking bead 52 may easily be pulled above the container neck bead with which it mates, the cap 46 may be removed.

In many respects the modifications of FIGS. 4–5, FIGS. 6–8 and FIG. 9 resemble those of preceding modifications and the same reference numerals followed by subscripts a, b and c, respectively, designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In a plastic bottle cap having a top and a skirt depending from said top, said skirt having a bottom edge and being formed with a first vertical score line extending upward from said bottom edge, and a tear tab extending downward from said bottom edge adjacent said first score line, the invention which comprises, a first rib extending outward along a longitudinal edge of said tear tab and extending outwardly of said skirt adjacent said first score line, said first rib being parallel to and adjacent said first vertical score line.

2. A cap according to claim 1 in which said rib has an outer edge which has a lower portion comprising a substantially straight line, an intermediate portion which is arcuate and an upper portion comprising a substantially straight line.

3. A cap according to claim 1 in which said first rib is on the outside of said tab.

4. A cap according to claim 1 in which said skirt comprises a frusto-conical upper portion and a cylindrical lower portion, said first score line extending up to said frusto-conical portion, said skirt having a horizontal second score line around said frusto-conical portion intersecting said first score line.

5. A cap according to claim 4 in which said horizontal second score line is internal.

6. A cap according to claim 1 in which said skirt has an upper portion adjoining said top and said top is formed with a horizontal second score line intersecting said first score line.

7. A cap according to claim 6 in which said horizontal second score line is internal.

8. A cap according to claim 6 in which said upper portion is frusto-conical.

9. A cap according to claim 1 in which said first rib tapers in height increasing from a minimum adjacent a lower end of said tear tab to a maximum vicinal said bottom edge and then decreasing to a terminus on said skirt spaced up from said bottom edge.

10. A cap according to claim 9 in which said first score line extends up said skirt higher than said terminus.

11. A cap according to claim 9 in which said tab slants downward-outward relative to a downward projection of said skirt.

12. A cap according to claim 11 in which an outer edge of said first rib extends at an angle beta relative to said skirt and said tab slants downward-outward relative to a downward projection of said skirt at an angle alpha and in which alpha is greater than beta.

13. A cap according to claim 1 in which said skirt is formed with a second vertical score line spaced from said first score line, said tab extending downward between the intersections of said score lines with said bottom edge.

14. A cap according to claim 13 which further comprises a second rib extending outwardly of said skirt along a second longitudinal edge of said tear tab opposite said first rib and adjacent said second score line, said second rib being parallel to said second vertical score line.

15. A cap according to claim 14 in which said second rib is substantially congruent to said first rib.

16. A cap according to claim 14 which further comprises a bead on said skirt above said bottom edge, said bead being interrupted between said score lines.

17. A cap according to claim 14 in which said tear tab between said ribs is of substantially uniform thickness.

18. In a plastic bottle cap having a top and a skirt depending from said top, said skirt having a bottom edge and being formed with a vertical score line extending upward from said bottom edge, and a tear tab extending downward from said bottom edge adjacent said score line, the invention which comprises:

a rib on an inner surface of said tear tab along a longitudinal edge of said tear tab extending inward from said tear tab, said rib being parallel to and adjacent said vertical score line.

19. A cap according to claim 18 in which said tab is separated from said skirt for a substantial distance above said bottom edge.

20. A cap according to claim 19 in which said first rib extends for a substantial distance above said bottom edge.

21. A plastic bottle cap comprising a top, a frusto-conical skirt portion below said top, an internal locking bead at the lower end of said frusto-conical skirt portion, a cylindrical skirt portion below said frusto-conical portion, said cylindrical skirt portion having a bottom edge, and a tear tab extending downward from said bottom edge, said cap being formed with a vertical score line extending upward from said bottom edge into said frusto-conical skirt portion above said locking bead and a rib along a longitudinal edge of said tear tab and along said cylindrical skirt portion parallel to and adjacent said vertical score line.

22. A cap according to claim 21 which further comprises a second rib along a second longitudinal edge of said tear tab opposite said first rib, said cap being formed with a second vertical score line, said tab extending downward between the intersections of said score lines with said bottom edge, said second rib being parallel to and adjacent said second score line.

23. A cap according to claim 22 in which said second vertical score line extends above said locking bead.

* * * * *